US006305941B1

(12) United States Patent
Kotsiopoulos et al.

(10) Patent No.: US 6,305,941 B1
(45) **Date of Patent: *Oct. 23, 2001**

(54) TRAINING WEAPON WITH TRIGGER ACTUATED INDICATOR LIGHT

(76) Inventors: Thomas G. Kotsiopoulos, 404 Hillcrest, Prospect Heights, IL (US) 60070; Jim Jansen, 21431 W. Orchard Dr., New Berlin, WI (US) 53146

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/419,043

(22) Filed: Oct. 15, 1999

Related U.S. Application Data

(62) Division of application No. 09/079,977, filed on May 15, 1998, now Pat. No. 5,993,215.

(51) Int. Cl.[7] ..... F41A 33/00

(52) U.S. Cl. ..... 434/11; 42/1.01; 42/70.01

(58) Field of Search ..... 42/70.01, 70.11, 42/70.07, 1.02, 1.01, 84, 1.04; 33/234; 496/175, 406; 124/73, 75; 434/11

(56) References Cited

U.S. PATENT DOCUMENTS

| | | | | |
|---|---|---|---|---|
| 4,175,353 | * | 11/1979 | Pickett | 446/406 |
| 4,739,569 | * | 4/1988 | Battle | 42/1.01 |
| 4,829,692 | * | 5/1989 | Guild | 42/1.01 |
| 5,016,378 | * | 5/1991 | Sain | 42/1.01 |
| 5,233,776 | * | 8/1993 | Hessey | 446/175 |
| 5,253,068 | * | 10/1993 | Crook et al. | 446/175 |
| 5,375,847 | * | 12/1994 | Fromm et al. | 446/175 |
| 5,448,847 | * | 9/1995 | Teetzel | 42/1.01 |
| 5,519,953 | * | 5/1996 | Villani | 42/1.02 |
| 5,603,180 | * | 2/1997 | Houze | 42/1.01 |
| 5,735,070 | * | 4/1998 | Vasquez et al. | 42/1.02 |
| 6,003,504 | * | 12/1999 | Rice et al. | 124/73 |

* cited by examiner

*Primary Examiner*—Sam Rimell
(74) *Attorney, Agent, or Firm*—Leydig, Voit & Mayer, Ltd.

(57) ABSTRACT

A training weapon for use in firearm training simulations involving multiple participants each of whom is armed with a training weapon. The training weapon includes a trigger which is coupled with a switch that is part of an electrical circuit including a power supply and an indicator light. The trigger and switch being arranged such that when the trigger is depressed the switch closes the circuit thereby turning on the indicator light.

16 Claims, 2 Drawing Sheets

TRAINING WEAPON WITH TRIGGER ACTUATED INDICATOR LIGHT

CROSS REFERENCE TO RELATED APPLICATION

This application is a divisional of U.S. patent application Ser. No. 09/079,977 filed May 15, 1998, now U.S. Pat. No. 5,993,215.

FIELD OF THE INVENTION

This invention generally relates to the weaponry art, and more particularly, to a weapon for use in training exercises, simulations or the like.

BACKGROUND OF THE INVENTION

Exercises, simulations and the like are extremely useful tools for training individuals, including for example law enforcement and military personnel, in the use of firearms. One particularly useful type of training exercise or simulation involves confronting an individual having a firearm with a series of "friendly" and "unfriendly" targets. In such an simulation, the object is for the trainee to fire his or her weapon at the "unfriendly" targets while refraining from firing at the "friendly" targets.

A variation on this training exercise is to have multiple participants involved in the simulation. Exercises involving multiple participants can be much more chaotic, making it difficult for the individual participants and for observers to determine and evaluate what happened. In particular, difficulties can arise in determining which of the individual participants "fired" their weapons at a particular target and also when a participant discharged his or her weapon. Often in the heat of an exercise, an individual can fire his weapon without recalling it afterwards or even realizing it at the time he fires the weapon. In addition, a participant can believe he fired, or recall firing, his weapon when he actually did not fire. As will be appreciated, information concerning which of the individual participants fired at a particular target and when they fired at a particular target is essential to analyzing and evaluating the training exercise and to providing the participants with useful feedback.

OBJECTS AND SUMMARY OF THE INVENTION

Accordingly, in view of the foregoing, it is an general object of the present invention to provide an system for training personnel in the use of firearms which affords greater feedback with respect to when and by whom weapons are fired.

A related object of the present invention is to provide a training weapon which generates a clearly recognizable signal when the trigger is actuated.

Another object of the present invention is to provide a training system and weapon as characterized above which is relatively inexpensive to produce, install and operate.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 2:
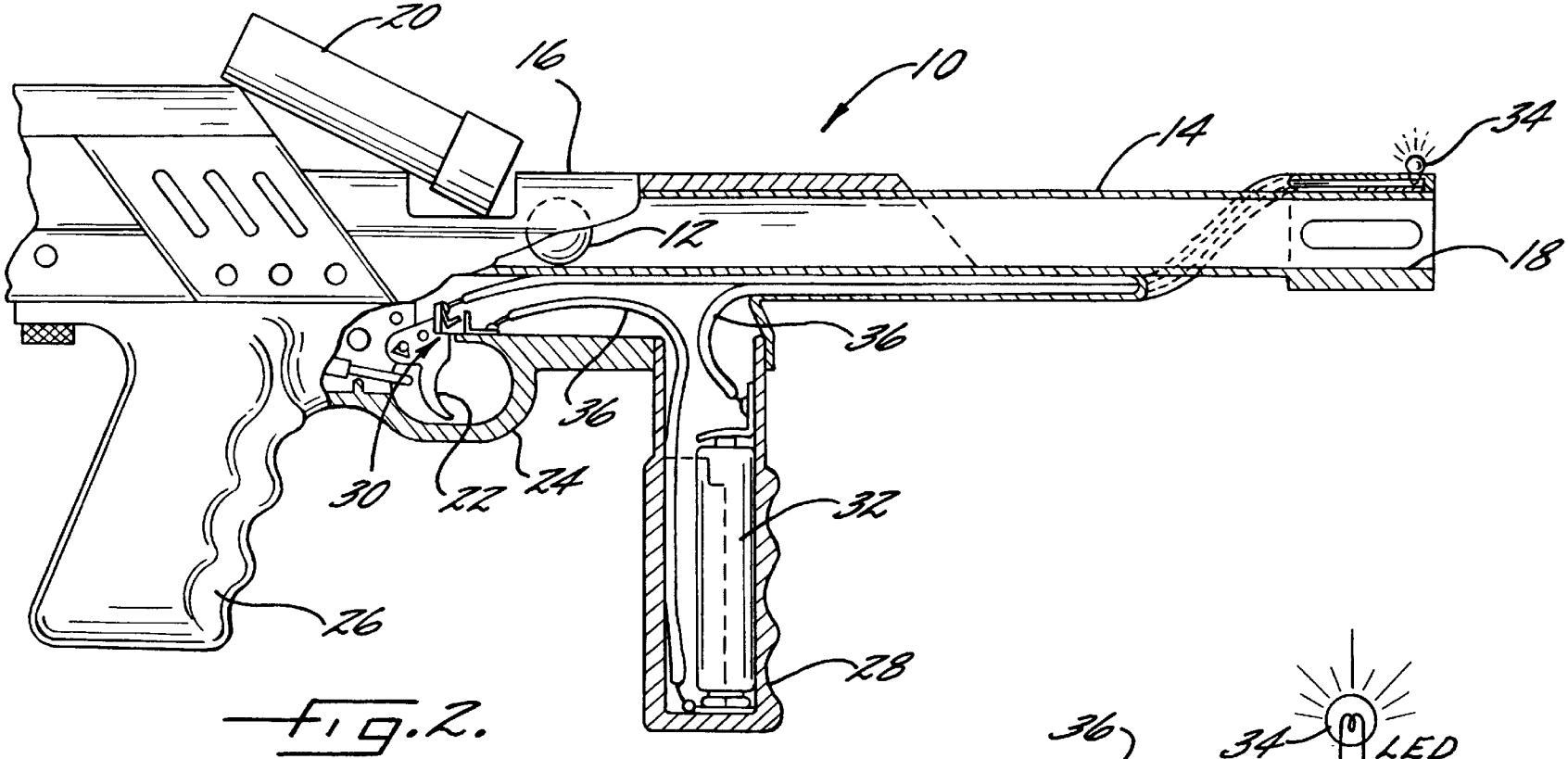
FIG. 2 is a partially cut away side view of one embodiment of a hand-held compressed gas powered training weapon constructed in accordance with the teachings of the present invention.

Referring now more particularly to FIG. 2 there is shown an illustrative embodiment of a training weapon for use in training exercises, simulations or the like for individuals such as law enforcement and military personnel which embodies the teachings of the present invention. The illustrated training weapon 10 comprises a compressed gas powered marking pellet gun which is sometimes also referred to as a "paint ball" gun. The training weapon fires relatively fragile projectiles 12, sometimes referred to as "paint balls" which have a frangible shell that is filled with a marking composition. These projectiles are designed to break upon impact with an object and thereby discharge the marking composition onto the object. While the present invention is described in connection with a compressed gas powered paint ball gun, it will be readily appreciated by those skilled in the art that the teachings of the present invention can be applied to training weapons have other configurations. For example, while it is useful in terms of determining whether a participant or trainee has hit a target, it is not necessary for the present invention for the training weapon to be capable of firing a projectile of any kind.

For directing the projectile when it is fired, the training weapon 10 includes an elongate, longitudinally extending generally cylindrical barrel 14. The barrel 14 is carried by a longitudinally extending frame member 16 and has an open front end 18 through which the projectile 12 is expelled when the training weapon 10 is fired. To feed a supply of projectiles 12 to the training weapon 10, an ammunition feeding tube 20 is provided on the frame member 16 which feeds a plurality of projectiles to the training weapon, one at a time, as will be understood by those skilled in the art. The frame member 16 also carries, in this instance, an air inlet (not shown) to which a compressed gas source such as an air line, hose, canister or the like can be connected so as to supply compressed gas to the training weapon. The training weapon further includes a pivotally mounted trigger 22, a trigger guard 24, a handle 26 and a forward grip or handle 28 each of which depends downwardly from the frame member 16.

For propelling the projectiles 12, the training weapon 10 includes a firing mechanism or system. The firing mechanism generally comprises a pressure regulating assembly (not shown) which operates to control the pressure of the compressed gas received from the compressed gas source and a firing chamber which stores the compressed gas that is used to propel the projectile 12. The firing mechanism also includes various fluid passageways which interconnect the regulating assembly and the firing chamber. As will be appreciated by those skilled in the art, the firing mechanism is operable in a firing mode wherein a projectile is expelled from the training weapon 10 and a ready-to-fire or reloading mode which places the training weapon in condition for firing. Upon actuation of the firing mechanism, the blast of compressed gas exits the firing chamber and thereby propels the projectile 12. Once the compressed gas in the firing chamber is released, a recoil spring drives an actuating bolt rearwardly against a bumper where it is held in place by the force of the recoil spring. The pressure to which the firing chamber is charged, and thereby the velocity of the projectile 12, can be adjusted via a threaded velocity nut provided on the rear end of the frame member 16 of the training weapon. In order to allow the firing chamber to charge at very nearly the full line pressure of the compressed gas source and thereby fill much more rapidly, the firing system may be configured as disclosed in co-pending U.S. application Ser. No. 08/955,187, filed Oct. 21, 1997 which is incorporated herein by reference. Alternatively, the firing system may be configured as disclosed in U.S. Pat. No. 5,280,778 which is also incorporated herein by reference.

For actuating the firing mechanism, the training weapon 10 includes a trigger mechanism. As described in detail in said U.S. Pat. No. 5,280,778 and said U.S. application Ser. No. 08/955,187, the firing mechanism is actuated through the use of a trigger mechanism which includes a rotatable sear. The trigger mechanism further includes a sliding trigger arm which operates to transmit force from the trigger 22 to the sear. As explained in detail in said U.S. Pat. No. 5,280,778, this can provide for semi-automatic firing of the training weapon 10 in operation. In order to allow provide the sensation of a "reactive trigger" which "pushes" the finger of a user after the training weapon is fired through the execution of a pull stroke of the trigger thereby helping a user achieve a faster firing rate, the trigger mechanism may be configured as disclosed in co-pending U.S. application Ser. No. 08/955,047, filed Oct. 21, 1997 which is incorporated herein by reference.

Figure 3:
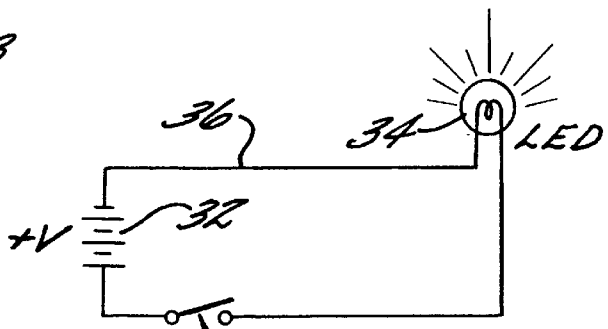
FIG. 3 is a circuit diagram of the trigger actuated indicator light of the training weapon of FIG. 2.

In accordance with an important aspect of the present invention, the training weapon 10 is equipped with a trigger actuated indicator light 34 which makes the training weapon 10 particularly well suited for training exercises or simulations involving numerous participants each of whom is equipped with a training weapon. In general, the trigger 22 of the training weapon 10 is coupled with a switch 30 that is part of an electrical circuit, shown in FIG. 3, including a power supply 32 and an indicator light 34. When the trigger 22 is depressed, the switch 30 closes the circuit and the indicator light 34 is turned on or lit. In the illustrated embodiment, shown in FIG. 2, the indicator light 34 is arranged in a prominent position, proximate the open front end 18 of the barrel. It will be appreciated that the indicator light 34 may be positioned in other locations so long as the indicator light is readily observable. The power source 32, which comprises a conventional battery, is disposed inside the front handle 26 of the training weapon. Those skilled in the art will appreciate that other types of power sources, such as a connection to a fixed AC power source, as well as other locations on or within the training weapon may be used. In the illustrated embodiment, the wiring 36 interconnecting the switch 30, power source 32 and indicator light 34 is arranged substantially on the interior of the training weapon 10 so as to prevent it from being damaged.

Figure 1:
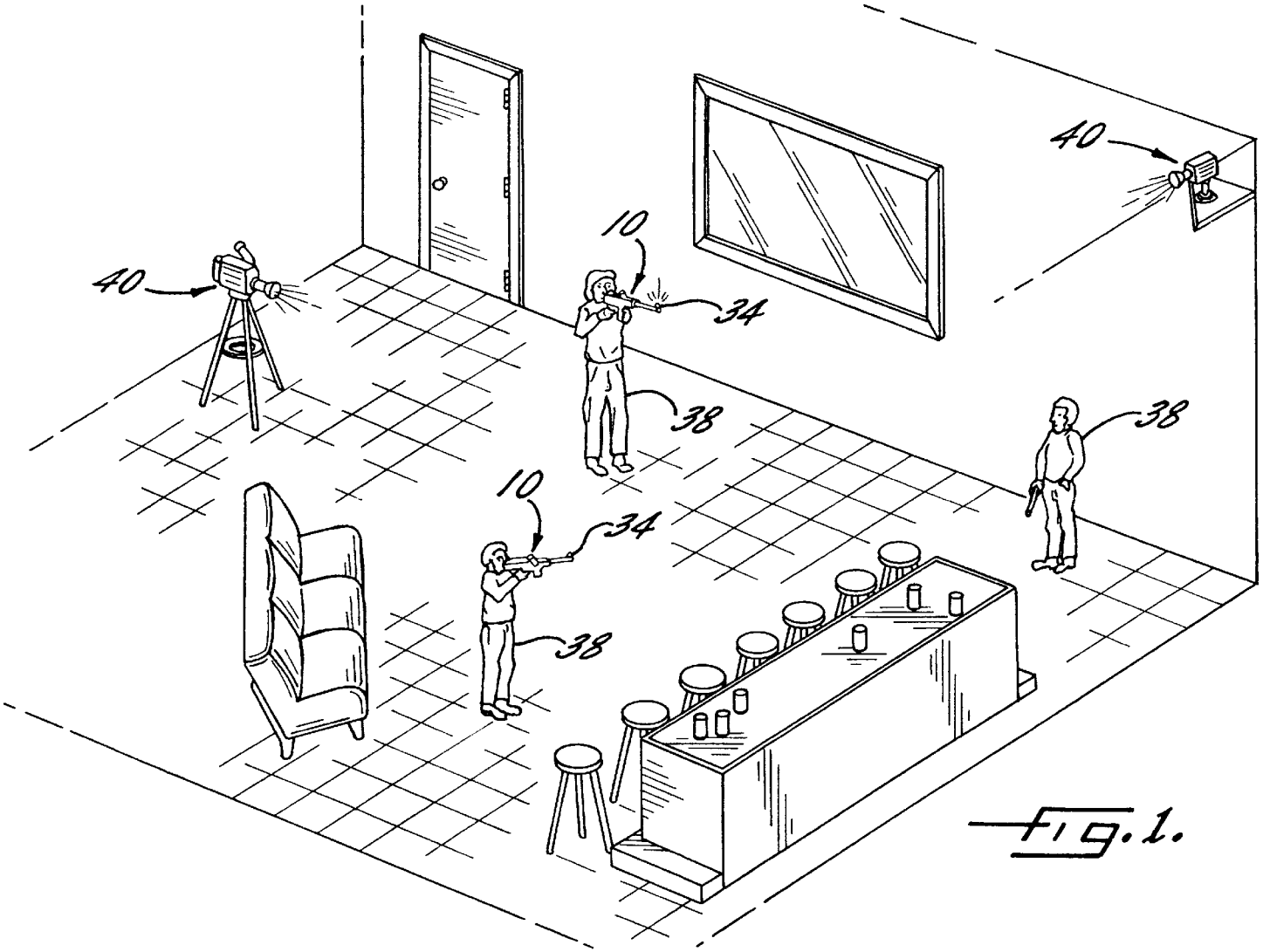
FIG. 1 is a perspective view of an illustrative training exercise utilizing the teachings of the present invention.

A further important aspect of the present invention resides in a method for utilizing the training weapon 10 in a training exercise or simulation which involves multiple participants. Referring more particularly to FIG. 1, there is shown an illustrative example of a training exercise or simulation which involves multiple participants 38, each of whom is equipped with a training weapon 10. The training simulation is intended to further include video equipment 40, two video recorders in the illustrated embodiment, which is arranged to capture the training exercise on videotape or the like. During playback of the video, actuation of the training weapons 10 of the individual participants 38 can be verified through observation of the indicator lights 34 on their particular weapon. In this way, whether an individual trainee fired his weapon 10, when he fired it and how many times he fired the weapon can be readily observed simply by looking for the indicator light 34. Those skilled in the art will appreciate that the simulation or exercise may involve a variety of different scenarios including presenting the participants with a series of "friendly" and "unfriendly" targets or it may pit one or more groups of participants against one another with fellow participants being the target. In addition, as noted above, the individual training weapons 10 may also be adapted to fire paint balls in order to provide further feedback to the participants with respect to items such as firing accuracy.

While this invention has been described with an emphasis upon preferred embodiments, it will be obvious to those of ordinary skill in the art that variations of the preferred embodiments may be used and that it is intended that the invention may be practiced otherwise than as specifically described herein. Accordingly, this invention includes all modifications encompassed within the spirit and the scope of the invention as defined by the following claims.

What is claimed is:

1. A weapon for use in an exercise or simulation for training individuals in the use of firearms, the training weapon comprising:

a frame member, a barrel supported by the frame member, a trigger supported by the frame member for movement between a firing position and a non-firing position, an electrically operable indicator light arranged in a readily observable position on the weapon, an electrical power source in electrical connection with the indicator light, a switch in electrical connection with the power source and the indicator light and coupled to the trigger such that the indicator light is lit by moving the trigger from the non-firing position to the firing position, and a firing mechanism for actuating discharge of a projectile through an open front end of the barrel when the trigger is moved from the non-firing position to the firing position.

2. The invention according to claim 1 wherein the indicator light is arranged on the barrel.

3. The invention according to claim 2 wherein the indicator light is arranged proximate a front end of the barrel.

4. The invention according to claim 1 wherein the power source comprises a battery.

5. The invention according to claim 1 wherein the power source is arranged in a handle which is supported by the frame member.

6. The invention according to claim 1 wherein the indicator light is unlit by moving the trigger from the firing position to the non-firing position.

7. The invention according to claim 1 wherein the switch coupled to the trigger such that the switch is closed to light the indicator light when the trigger is in the firing position and the switch is open so that the indicator light is unlit when the trigger is in the non-firing position.

8. An apparatus for training individuals in the use of firearms, the apparatus comprising:

a training weapon comprising:

a frame member, a barrel supported by the frame member, a trigger supported by the frame member for movement between a firing position and a non-firing position, an electrically operable indicator light arranged in a readily observable position on the weapon, an electrical power source in electrical connection with the indicator light, and a switch in electrical connection with the power source and the indicator light and coupled to the trigger such that the indicator light is lit by moving the trigger from the non-firing position to the firing position, and a video recording apparatus for recording an image of the indicator light on the training weapon during a training exercise.

9. The invention according to claim 8 wherein the indicator light is arranged on the barrel.

10. The invention according to claim 9 wherein the indicator light is arranged proximate a front end of the barrel.

11. The invention according to claim 8 wherein the power source comprises a battery.

12. The invention according to claim 8 wherein the power source is arranged in a handle which is supported by the frame member.

13. The invention according to claim 8 further including a firing mechanism for actuating discharge of a projectile through an open front end of the barrel when the trigger is moved from the non-firing position to the firing position.

14. The invention according to claim 8 wherein the indicator light is unlit by moving the trigger from the firing position to the non-firing position.

15. The invention according to claim 8 wherein the switch coupled to the trigger such that the switch is closed to light the indicator light when the trigger is in the firing position and the switch is open so that the indicator light is unlit when the trigger is in the non-firing position.

16. The invention according to claim 8 wherein the video recording apparatus comprises a video camera.

* * * * *